US011680536B2

(12) United States Patent
Moine

(10) Patent No.: US 11,680,536 B2
(45) Date of Patent: Jun. 20, 2023

(54) METHOD FOR MANAGING A PISTON PUMP FOR A HEAT ENGINE

(71) Applicant: VITESCO TECHNOLOGIES GMBH, Hanover (DE)

(72) Inventor: Xavier Moine, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 150 days.

(21) Appl. No.: 17/424,362

(22) PCT Filed: Jan. 23, 2020

(86) PCT No.: PCT/EP2020/051577
§ 371 (c)(1),
(2) Date: Jul. 20, 2021

(87) PCT Pub. No.: WO2020/152248
PCT Pub. Date: Jul. 30, 2020

(65) Prior Publication Data

US 2022/0090557 A1 Mar. 24, 2022

(30) Foreign Application Priority Data

Jan. 24, 2019 (FR) ..... 1900607

(51) Int. Cl.
*F02D 41/30* (2006.01)
*F02D 41/06* (2006.01)
(Continued)

(52) U.S. Cl.
CPC ..... *F02D 41/3082* (2013.01); *F02D 41/062* (2013.01); *F02M 37/08* (2013.01);
(Continued)

(58) Field of Classification Search
CPC ... F02D 41/3082; F02D 41/062; F02M 37/08; F02M 51/04; F02M 59/025; F02M 59/10;
(Continued)

(56) References Cited

U.S. PATENT DOCUMENTS 4,750,514 A * 6/1988 Omori ..... F02M 59/32 251/129.18
5,678,521 A * 10/1997 Thompson ..... F02M 41/04 123/446
(Continued)

FOREIGN PATENT DOCUMENTS

CN 101294534 10/2008
CN 102052177 5/2011
(Continued)

OTHER PUBLICATIONS

International Search Report for PCT/EP2020/051577 dated Apr. 7, 2020, 5 pages.
(Continued)

*Primary Examiner* — Sizo B Vilakazi
(74) *Attorney, Agent, or Firm* — Nixon & Vanderhye

(57) ABSTRACT

Disclosed is a method for managing a piston pump using a computer of a vehicle, the pump including a guide, a piston slidably mounted in the guide, and a solenoid, suitable for moving the piston, the method including, as long as the fuel pressure in the compression chamber of the pump is below a predetermined pressure threshold, a step of the computer controlling the solenoid in order to move the piston to its high position, and a step of the computer detecting that the predetermined pressure threshold has been exceeded when the current value, measured after a predetermined period, is greater than or equal to a predetermined reference value so that the computer ceases to control the solenoid.

20 Claims, 3 Drawing Sheets

(51) Int. Cl.

| | |
|---|---|
| ***F02M 37/08*** | (2006.01) |
| ***F02M 51/04*** | (2006.01) |
| ***F02M 59/02*** | (2006.01) |
| ***F02M 59/10*** | (2006.01) |
| ***F04B 17/04*** | (2006.01) |
| ***F04B 49/02*** | (2006.01) |
| ***F04B 49/06*** | (2006.01) |
| ***F04B 49/08*** | (2006.01) |

(52) U.S. Cl.
CPC ..... *F02M 51/04* (2013.01); *F02M 59/025* (2013.01); *F02M 59/10* (2013.01); *F04B 17/04* (2013.01); *F04B 49/022* (2013.01); *F04B 49/065* (2013.01); *F04B 49/08* (2013.01); *F04B 2203/0401* (2013.01)

(58) Field of Classification Search
CPC . F02M 2037/085; F04B 17/04; F04B 49/022; F04B 49/065; F04B 49/08; F04B 2203/0401; F04B 49/06
See application file for complete search history.

(56) References Cited

U.S. PATENT DOCUMENTS

| | | | | |
|---|---|---|---|---|
| 7,021,261 | B2 * | 4/2006 | Joos | F02D 41/062 123/179.17 |
| 7,328,690 | B2 * | 2/2008 | Sheikh | F02D 41/406 123/458 |
| 7,467,619 | B2 * | 12/2008 | Sheikh | F02M 65/005 123/499 |
| 8,257,052 | B2 * | 9/2012 | Livoti | F04B 43/04 417/44.11 |
| 2012/0060948 | A1 * | 3/2012 | Okazono | B60K 15/077 137/565.17 |
| 2014/0166136 | A1 * | 6/2014 | Okazono | F02M 37/106 137/565.24 |
| 2017/0107931 | A1 * | 4/2017 | Anetsberger | F02M 59/022 |
| 2017/0314548 | A1 * | 11/2017 | Graf | F04B 49/08 |
| 2018/0023557 | A1 * | 1/2018 | Krusch | F04B 49/06 417/12 |
| 2019/0003611 | A1 * | 1/2019 | Fochtman | F04B 53/1035 |

FOREIGN PATENT DOCUMENTS

| | | |
|---|---|---|
| CN | 203067142 | 7/2013 |
| CN | 103850836 A | 6/2014 |
| EP | 1 438 495 | 7/2004 |
| EP | 1 904 745 | 4/2008 |
| FR | 2 847 708 | 5/2004 |
| FR | 2 984 499 | 6/2013 |
| FR | 3 021 997 | 12/2015 |
| JP | 2001-182593 | 7/2001 |
| TW | M506206 | 8/2015 |
| WO | 03/038260 | 5/2003 |
| WO | 2006/060545 | 6/2006 |
| WO | 2007/007365 | 1/2007 |

OTHER PUBLICATIONS

Written Opinion of the ISA for PCT/EP2020/051577 dated Apr. 7, 2020, 8 pages.
Office Action and Search Report issued in Chinese Patent Application No. 202080010739.4 dated Nov. 3, 2022.

* cited by examiner

[Fig. 1]
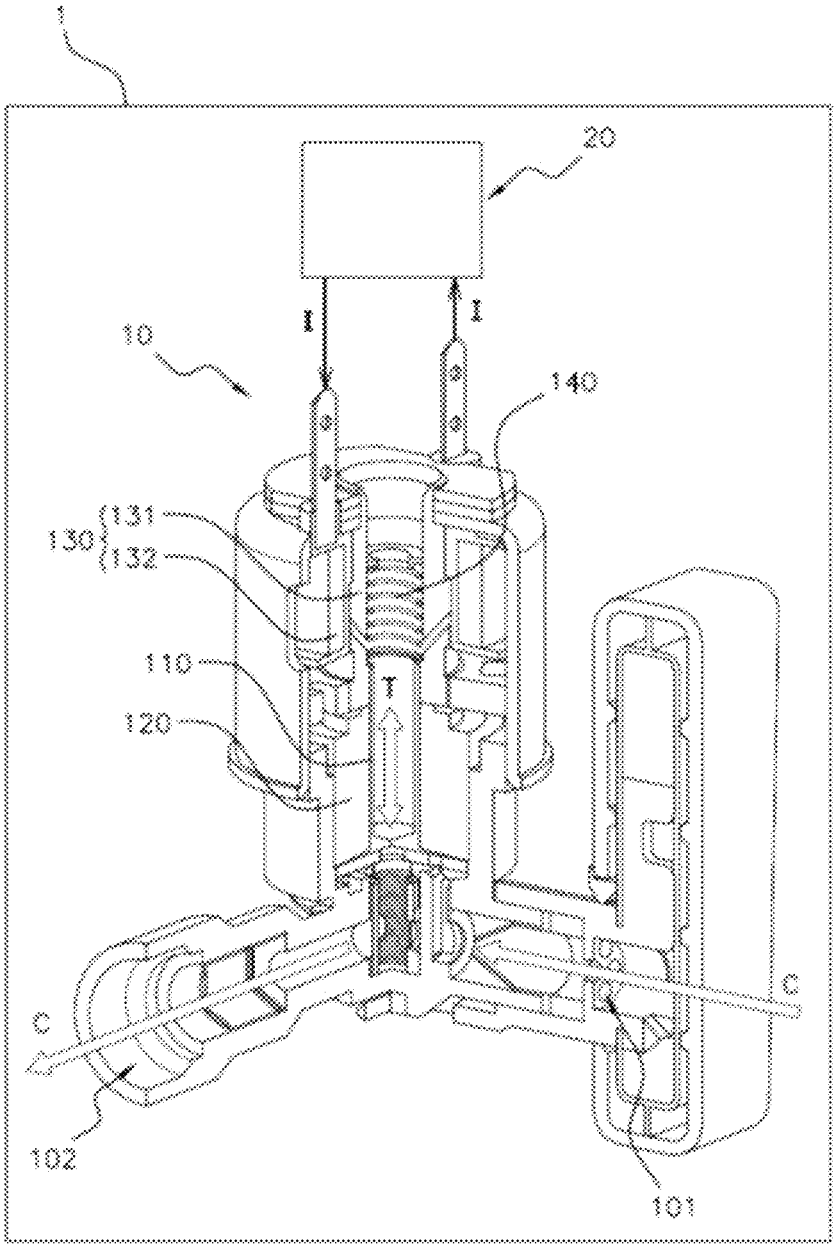

[Fig. 2]
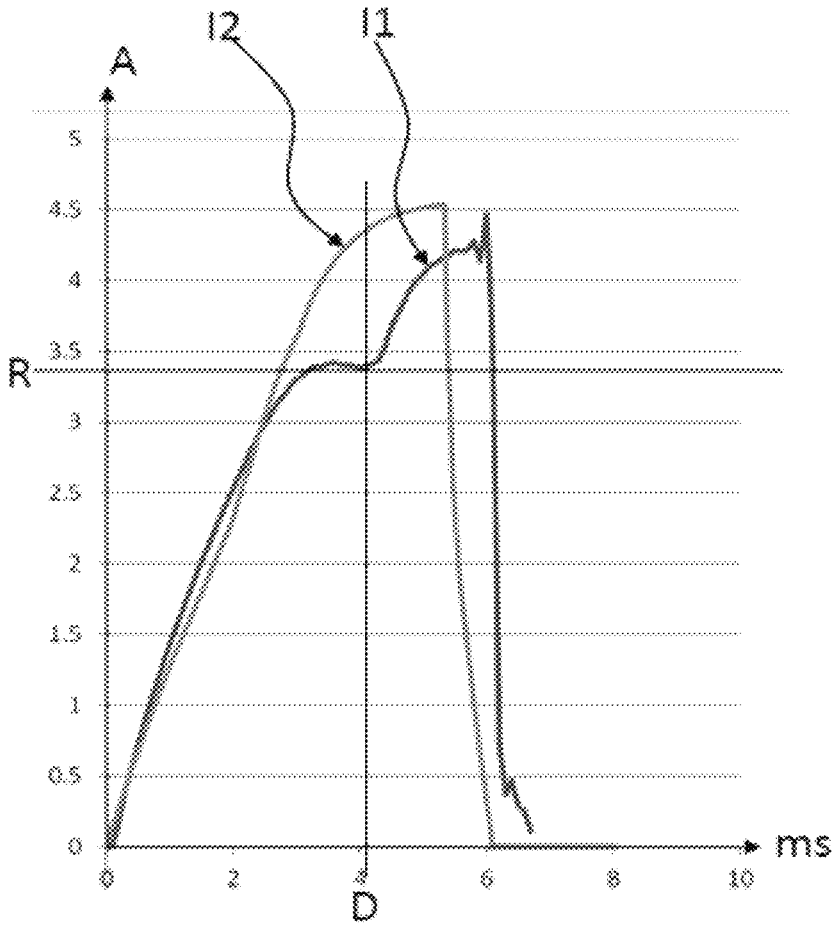

[Fig. 3]
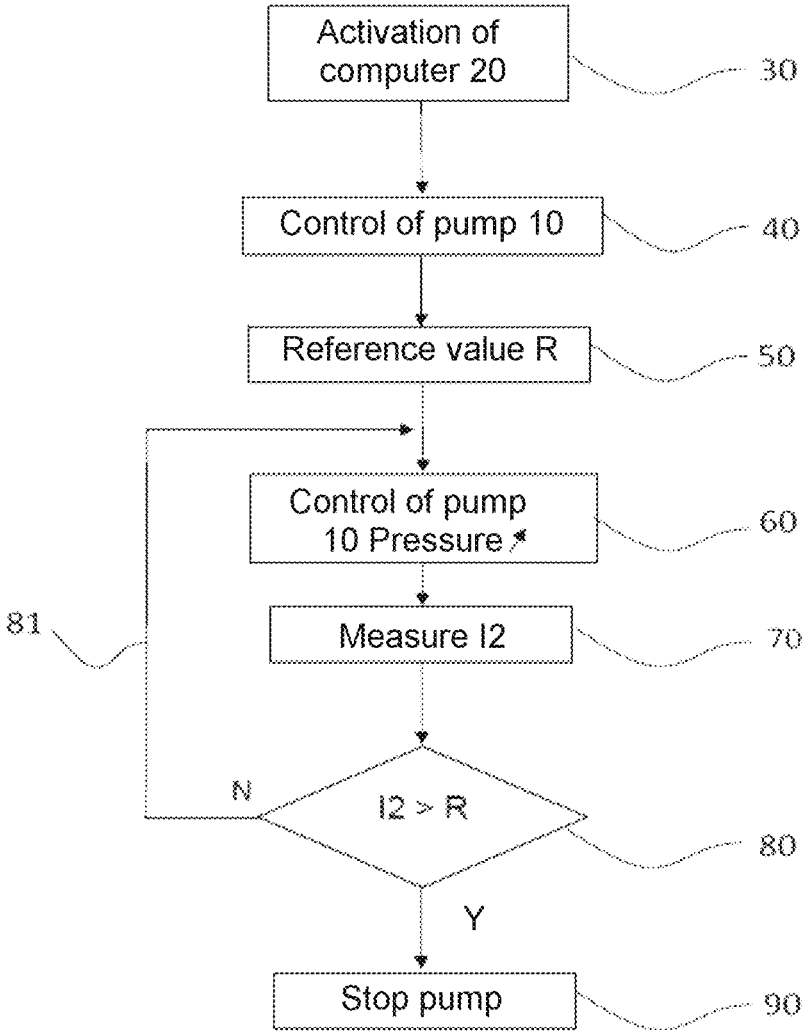

METHOD FOR MANAGING A PISTON PUMP FOR A HEAT ENGINE

CROSS-REFERENCE TO RELATED APPLICATIONS

This application is the U.S. national phase of International Application No. PCT/EP2020/051577 filed Jan. 23, 2020 which designated the U.S. and claims priority to French Application No. 1900607 filed Jan. 24, 2019, the entire contents of each of which are hereby incorporated by reference.

BACKGROUND OF THE INVENTION

Field of the Invention

The invention relates to the field of the injection of fuel into a combustion engine and relates more particularly to a method for managing a fuel injection pump. The invention applies more particularly to small cylinder-capacity combustion engines such as, for example, motorcycle engines with a cylinder capacity of less than 125 $cm^3$, or lawnmower engines.

Description of the Related Art

As is known, the injection of fuel into a cylinder of a combustion engine is performed using a pump. In the case of small cylinder-capacity engines, for example motorcycle or lawnmower engines with a cylinder capacity of less than 125 cm3, it is known practice to use piston pumps or turbine pumps in order to pressurize the fuel to be injected. In the case of a turbine pump, the turbine is rotated by an electric motor. In the case of a piston pump, the fuel is pressurized by the actuation of a piston. In both cases, a valve is mounted after the pump and is actuated by a spring the stiffness of which allows the valve to open when the pressure of the fuel exceeds a predetermined threshold. This spring-loaded valve system thus act as a pressure regulator. However, the use of a pump and an external pressure regulator increases the footprint and complexity of the system.

In order to overcome this drawback, it is known practice to use a pump in which the piston is actuated using a magnetic field generated by a solenoid mounted in the pump. More specifically, the pump comprises a piston, translatably mounted in a guide in order to form a fuel compression chamber, a solenoid, positioned at the upper end of the guide in order to move the piston upward during the intake phase, and a return spring allowing the piston to be moved downward during the compression phase when the solenoid ceases to control the movement of the piston. Advantageously, the stiffness of the return spring is predetermined so as to move the piston as long as the pressure of the fuel in the compression chamber is below a predetermined threshold. The use of a return spring thus makes it possible to incorporate the pressure regulation into the pump.

However, such a piston pump with internal pressure regulation also has its drawbacks. When the solenoid controls the movement of the piston, the piston moves rapidly to its high position in which it strikes the core of the solenoid, generating noise disturbance.

In addition, in certain conditions, particularly during the engine starting phase, the fuel pressure between the pump and the engine is low. Also, during the operation of the pump, the low fuel pressure at the outlet of the pump offers little or no resistance to the return spring, which then moves the piston rapidly to its low position in which it strikes the bottom of the cylinder, which likewise generates noise disturbance. In other words, in this case, the piston generates noise by striking the solenoid in the high position and striking the cylinder in the low position until pressure is established between the engine and the pump.

In particular, in the starting phase of the vehicle, during which the pump operates to pressurize the fuel when the combustion engine has not yet started, as there is no engine noise, the noise of the pump then becomes particularly audible, notably for individuals in the vehicle or around the vehicle, which presents a drawback. In addition, as this phase can be relatively long, the noise disturbance remains audible for a significant length of time, which therefore presents a major drawback.

There is therefore a need for a solution that makes it possible to at least partially overcome these drawbacks.

SUMMARY OF THE INVENTION

The present invention aims to propose a simple, reliable and effective solution for limiting the noise generated by a piston pump.

To this end, the invention relates to a method for managing a piston pump of a fuel injection system on board a combustion engine vehicle using a computer of said vehicle, in the starting phase of the vehicle during which the pump operates to pressurize the fuel when the combustion engine has not yet started, said pump comprising a guide, a piston slidably mounted in said guide in order to form a fuel compression chamber, a solenoid suitable for, when a control current generated by the computer passes through it, moving the piston between a low position in which the compression chamber is suitable for being emptied of fuel and a high position in which the compression chamber is suitable for being filled with fuel— the intake phase— and a return spring acting on the piston to return it to the low position in the absence of said control current passing through the solenoid—the compression phase—said method being characterized in that it comprises, as long as the fuel pressure in the compression chamber is below a predetermined pressure threshold:

the piston initially being under the effect of the return spring, a step of the computer controlling the solenoid to move the piston to its high position, after a predetermined period, a step of the computer measuring a value of the intensity of the current passing through the solenoid, next, a step of suspending the controlling of the solenoid so that the return spring actuates the piston to the low position, the three steps above being repeated a minimum number of times in order to ensure that the fuel pressure increases, and a step of the computer detecting that the predetermined pressure threshold has been exceeded when the measured current value is greater than a predetermined reference value, so that the computer ceases controlling the solenoid, the operating period of the pump thus being limited, in the starting phase of the vehicle when the combustion engine has not yet started, through the detection of the exceeding of a pressure threshold, making it possible to ensure that the fuel is pressurized while minimizing the period during which the pump generates noise.

The measuring step is carried out on each pump stroke, and the predetermined period is the period between the start of controlling the pump and the time of the measurement. The pump control time is always longer than this measurement period. The terms “filled” and “emptied” are given to mean that the combustion chamber is at least partially filled or substantially filled, or respectively empty or substantially emptied of fuel. The predetermined reference value that makes it possible to determine the ceasing of the controlling of the pump is for example a threshold predetermined on the basis of calibration depending on the control voltage.

Using the method according to the invention, the operating period of the pump is limited through the detection of the exceeding of a pressure threshold. This period makes it possible to ensure that the fuel is pressurized while minimizing the period during which the pump generates noise. In addition, it is easy to detect that a pressure threshold has been exceeded using the measured current value and this requires few or no additional elements, which limits the cost of detection.

Preferably, the method according to the invention comprises a preliminary initialization step comprising:

the piston initially being in its low position under the effect of the return spring, a sub-step of the computer controlling the solenoid in order to move the piston to its high position, at the end of the predetermined period, a sub-step of the computer measuring the value of the intensity of the current passing through the solenoid, known as the "reference value", followed by a sub-step of the computer ceasing to control the solenoid in order to move the piston to its low position under the effect of the return spring.

Through the initialization step, the computer can thus determine the reference value that corresponds to the high position of the piston. Comparing the current measurements with this reference value thus makes it possible to ensure that the pressure threshold is reliably detected. Under the effect of leaks, the first instance of control always leads to a full stroke even if the fuel pressure is already high. This preliminary initialization step can advantageously replace the predetermining of the threshold on the basis of calibration depending on the control voltage.

Advantageously, the method comprises a step of adjusting the reference value. This makes it possible to allow a margin in order to prevent erroneous detection that the pressure threshold has been exceeded.

Preferably, the reference value is adjusted by increasing the value of the intensity of the current measured during the measuring sub-step by a predetermined value, preferably of the order of 0.5 A.

Advantageously, the measurement step and the comparison step are repeated at a predetermined frequency, preferably of the order of 10 ms. Conventionally, the predetermined frequency is the same throughout the method. For example, the pump is controlled for 5 ms every 10 ms and the current is measured 4 ms after the start of control.

Still preferably, these steps are repeated a minimum number of times, preferably 10, in order to ensure that the fuel pressure increases.

Advantageously, as the piston pump supplies an engine of a vehicle, the method comprises an initial step of detecting that the ignition switch of said vehicle has been engaged in order to allow the pump to pressurize the fuel before the engine starts.

The invention also relates to a computer for managing a piston pump of a fuel injection system on board a combustion engine vehicle, said pump comprising a guide, a piston slidably mounted in said guide in order to form a fuel compression chamber, a solenoid suitable for, when a control current generated by the computer passes through it, moving the piston between a low position in which the compression chamber is suitable for being emptied of fuel and a high position in which the compression chamber is suitable for being filled with fuel— the intake phase— and a return spring acting on the piston to return it to the low position in the absence of said control current passing through the solenoid— the compression phase— said computer being characterized in that it is configured to implement the steps of a method according to the invention.

The invention further relates to a vehicle, particularly a motor vehicle, comprising a combustion engine and a piston pump supplying said combustion engine with fuel, said pump comprising a guide, a piston slidably mounted in said guide in order to form a fuel compression chamber, a solenoid suitable for, when a control current generated by the computer passes through it, moving the piston between a low position in which the compression chamber is suitable for being emptied of fuel and a high position in which the compression chamber is suitable for being filled with fuel— the intake phase— and a return spring acting on the piston to return it to the low position in the absence of said control current passing through the solenoid— the compression phase— said vehicle comprising a computer according to the invention, configured to control said piston pump.

BRIEF DESCRIPTION OF THE DRAWINGS

Further features and advantages of the invention will become apparent from the following description, which is provided with reference to the appended figures, which are given by way of non-limiting examples and in which identical reference signs are assigned to similar objects.

FIG. 1 schematically illustrates a piston pump according to the invention, controlled by a solenoid.

FIG. 2 schematically illustrates various curves representing the current passing through the solenoid of the pump in FIG. 1.

FIG. 3 illustrates a flow chart of an exemplary embodiment of a method according to the invention.

DESCRIPTION OF THE PREFERRED EMBODIMENTS

The method according to the invention is intended to be implemented in a vehicle with a combustion engine in order to control a piston pump of said vehicle. The term "vehicle" is given in particular to mean a motor vehicle and a motorcycle (particularly having a cylinder capacity of less than 125 $cm^3$), but also devices with a small cylinder-capacity combustion engine such as, for example, a lawnmower.

FIG. 1 schematically shows one example of a vehicle 1 comprising a piston 110 pump 10 and a computer 20 for controlling the pump 10.

The vehicle 1, such as a motorcycle or a lawnmower, comprises a combustion engine (not shown) supplied with fuel C by a fuel tank (not shown). The combustion engine comprises a plurality of cylinders each defining a combustion chamber into which a volume of fuel C and a volume of air are introduced on each cycle of the engine in order to combust the mixture thereof.

Each cylinder comprises a piston mounted in the combustion chamber. The piston is suitable for being translated by the combustion of the mixture in the combustion chamber. The pistons rotate a main shaft of the engine, also referred to as the 'flywheel', thus allowing the engine to convert the energy released by combustion into mechanical energy.

In order to optimize the quantity of fuel C injected on each cycle of the engine, the vehicle 1 comprises a piston 110 pump 10 as illustrated in FIG. 1. Such a pump 10 makes it possible to increase the pressure of the fuel C before it is injected into the combustion chamber, in order to maximize the quantity of fuel C injected in a limited time. Such a pump 10 is particularly suitable for small cylinder-capacity engines, preferably less than 150 cm3, such as a motorcycle or lawnmower engine.

To this end, the pump 10 comprises a piston 110, a guide 120, a solenoid 130, and a return spring 140.

Still with reference to FIG. 1, the piston 110 is slidably mounted, or in other words translatably mounted T, in said guide 120.

The guide 120 extends longitudinally between a first end and a second end. The guide 120, illustrated in FIG. 1, extends vertically between a top end and the bottom end. The movement of the piston 110 is thus guided in the guide 120 between a high position and a low position as will be described hereinafter. The piston 110 and the guide 120 define a compression chamber into which a volume of fuel C, preferably of the order of 20 $mm^3$, coming from the fuel tank of the vehicle 1, is introduced so that it can be compressed before being injected into a combustion chamber.

The clearance between the piston 110 and the guide 120 allows the various gases present in the compression chamber to escape therefrom in order to allow optimum compression of the fuel C. According to one aspect of the invention, fuel C can also escape from the compression chamber as described hereinafter. In this example, the clearance is of the order of 10 microns. Such clearance makes it possible to ensure a leakage flow of fuel C from the compression chamber, for example greater than or equal to 50 $mm^3$ of fuel per second, allowing all of the fuel C present in the compression chamber to escape therefrom in a limited time. The clearance is limited so that it does not limit the output of the pump 10.

The pump 10 comprises an inlet 101 and an outlet 102 for fuel C. The inlet 101 is connected to the fuel tank of the vehicle 1 in order to supply the pump 10 with fuel C. The outlet 102 is connected to the inlet of the combustion chamber of the engine in order to supply it with pressurized fuel C. The pump 10 according to the invention comprises at least one inlet valve (not shown in FIG. 1 for the sake of clarity) mounted at the inlet 101 of the pump 10, and at least one outlet valve (not shown in FIG. 1 for the sake of clarity) mounted at the outlet 102 of the pump 10. Such valves are suitable for allowing the fuel C to pass through in just one direction. The inlet valve thus allows the fuel C to pass only from the tank to the pump 10, and the outlet valve allows the fuel C to pass only from the pump 10 to the combustion engine. The valves thus allow the fuel C to be guided from the tank to the engine via the pump 10, and prevent it from flowing in the opposite direction, particularly in order to ensure that the pressurized fuel C is sent to the engine.

Fuel C coming from the inlet 101 of the pump 10 thus enters the compression chamber of the pump 10, then leaves it via the outlet 102.

In the high position of the piston 110, the compression chamber has a maximum volume and is filled with fuel C.

In the low position of the piston 110, the compression chamber has a minimum volume, smaller than the volume of the compression chamber when the piston 110 is in the high position, and is emptied of fuel C. When the piston 110 moves from the high position to the low position under the effect of the return spring 140 and in the absence of control from the solenoid 130, the volume of the compression chamber thus decreases, which increases the pressure of the fuel C situated in the compression chamber. That allows pressurized fuel C to be sent to the engine. As will be described hereinafter, the stroke of the piston 110 vary according to the desired delivery of the pump 10. The greater the stroke of the piston 110, the greater the delivery of fuel C at the outlet 102 of the pump 10.

The piston 110 is made at least partially from a metallic material suitable for being attracted by a magnetic field so that it can be moved, as will be described hereinafter.

The solenoid 130 is mounted at the top end of the guide 120 so that when it is controlled by the computer 20, it moves the piston 110 upward to take fuel into the compression chamber.

Such a solenoid 130 comprises a core 131 and a coil 132 mounted around said core 131. An electric current flows in the coil 132 in order to generate a magnetic field. The magnetic field is suitable for attracting the piston 110 in order to move it to the top end of the guide 120, or in other words to its high position, defining an intake phase of the pump 10. In the high position, the piston 110 is in contact with the core 131. The operation of such a solenoid 130 is known and will not be described in greater detail here.

The return spring 140 is mounted in the guide 120 at the top end thereof in order to move the piston 110 downward. When the solenoid 130 ceases to control the movement of the piston 110, the return spring 140 thus moves the piston 110 to its low position, defining a compression phase of the pump 10.

The return spring 140 has a stiffness that allows the fuel C to be compressed in the compression chamber. Advantageously, the stiffness of the return spring 140 is predetermined in such a way as to compress the fuel C to the desired pressure.

When the fuel C present in the compression chamber reaches the desired pressure, the return spring 140 thus no longer moves the piston 110 to its low position, thereby making it possible to limit the pressure of the fuel C at the outlet of the pump 10. The stiffness of the return spring 140 also determines the speed of movement of the piston 110 to its low position, depending on the pressure of the fuel C in the compression chamber. The pressure of the fuel C exerts a force that opposes the movement of the piston 110 by the return spring 140. The lower the pressure of the fuel C, the smaller this force and therefore the more rapidly the piston 110 will move to its low position.

Such a return spring 140 thus performs a pressure-regulating function. Such regulation thus takes place inside the pump 10 and requires no additional elements.

The computer 20, also referred to as an Electronic Control Unit (or ECU) allows the pump 10 to be controlled via the solenoid 130.

More specifically, the computer 20 is configured to control the current C supplied to the solenoid 130, in order to control the movement of the piston 110, and therefore the pump 10. The time at which the computer 20 starts to control the solenoid 130 using current C defines a reference time that will be used subsequently.

The computer 20 is also configured to measure the value of the current passing through the solenoid 130 when the solenoid 130 is controlled. This current value represents the position of the piston 110 between its low position and its high position. More specifically, the shape of the current is highly dependent on the position of the piston at the time when the control of the solenoid starts. The computer 20 is in particular configured to measure the value of the current passing through the solenoid 130 at a predetermined time that corresponds to the time necessary for the piston 110 to move from its low position to its high position. Such a time can in particular be determined by detecting a point of inflection of the curve representing the current, for example by calculating the gradient of the current as shown in curve 11 in FIG. 2, which is described below.

The computer 20 is further configured to detect when the pressure in the compression chamber exceeds a predetermined threshold. To this end, the computer 20 is configured to compare a measured current value with a reference value R in order to detect that the threshold has been exceeded when the measured value is greater than the reference value R. It is useful to estimate the inflection only when the pump is first controlled (full stroke), in order to deduce the value of D therefrom. When the pump is controlled subsequently, the point of inflection occurs sooner but no attempt is made to determine it. The current is only measured at the end of the predetermined period D, as will be explained in greater detail hereinafter, which predetermined period D is fixed for each instance of control in the same application of the priming method.

Finally, the computer 20 is configured to detect its activation, for example by detecting the insertion of an ignition key of the vehicle 1 by a user or other means of activating the computer 20, for example remote activation means. The computer 20 can thus start to control the solenoid 130 and measure the current from the time when it detects that it has been activated. The control of the solenoid 130 from the time of activation of the computer 20 thus allows the pump 10 to pressurize the fuel C before the engine starts.

One embodiment of the method for managing the piston 110 pump according to the invention will now be described with reference to FIGS. 2 and 3.

When a user makes their presence known as set out above, the computer 20 then detects that it has been activated (step 30 in FIG. 3) and starts to control the solenoid 130 in order to pressurize the fuel C (step 40 in FIG. 3). In other words, the pressure of the fuel C increases before the engine of the vehicle 1 has started or is operating. The pump is controlled for a period and at a frequency as explained hereinafter, both of which depend on the air intake temperature and the supply voltage of the pump, as set out below:

at high temperatures, the control time must be extended and the frequency must be reduced to limit the formation of vapor, which reduces the efficiency of the pump;

the control time must be adjusted to the supply voltage of the pump. At low voltages, extending the control period can make it necessary to reduce the control frequency in order to ensure a minimum waiting time between two instances of control.

The computer 20 firstly determines a reference value R of the intensity of the current passing through the solenoid 130, this reference value R making it possible to determine when the piston 110 is in its high position. This is step 50 in FIG. 3, explained in detail below.

To this end, the computer 20 then sends a control current C through the solenoid 130 in order to generate a magnetic field that attracts the piston 110, initially situated in its low position, to its high position. During the movement of the piston 110, the computer 20 measures the value of the current I1 passing through the solenoid 130 as illustrated in FIG. 2. The computer 20 particularly measures the value of the current I1 after a predetermined period D, from the start of control by the computer 20, which corresponds to the period, known as the maximum period, for which the solenoid 130 is controlled by the computer 20 that makes it possible to move the piston 110 from its low position to its high position. This period D can particularly be determined by detecting a point of inflection of the signal representing the current I1 as shown in FIG. 2. The computer 20 thus determines the value of the intensity of the current passing through the solenoid 130 at the end of the period D, at the start of the method, that is, advantageously the first time the solenoid is controlled. This value then corresponds to the reference value R. According to one aspect of the invention, the computer 20 determines the reference value R by increasing the measured value in order to obtain a safety margin. This reference value R is independent of the pressure as this is the first pump stroke and during the intake phase. The curve I1 therefore represents the curve of current passing through the solenoid during the intake phase and during the full stroke of the piston between stops. When the piston 110 is in the high position, the control of the solenoid 130 is then suspended and the return spring 140 returns the piston to the low position. When the pressure increases over the course of the control cycles of the solenoid, the piston eventually no longer returns to the low position due to the counter-pressure, and the more the pressure increases, the more the low position of the piston "rises" toward the high position on each cycle.

After this initialization step, the computer 20 controls the solenoid 130 again in order to repeat the "control and suspended control" cycles, in order to increase the pressure of the fuel C. This is step 60 in FIG. 3 as explained in detail below.

To this end, the computer 20 sends a control current through the solenoid 130 in order to move the piston 110 to its high position on each cycle. During this movement, the computer 20 measures the value of the current I2 passing through the solenoid 130 as illustrated in FIG. 2. This is step 70 in FIG. 3. The computer 20 then determines the value of the current I2 thus measured after the predetermined period D since the start of the controlling of the movement of the piston 110 by the computer 20 in a cycle. The predetermined period D corresponds to the period established in the initialization phase that corresponds to the piston reaching the high position on the first pump stroke. The period D does not vary during the method, and it will thus be understood that the value of the current increases when it is measured at this time, while the point of inflection moves on and the current value decreases at said point of inflection, being at a lower current value when the pressure threshold is reached at the point of inflection of the curve. In step 80 in FIG. 3, the computer 20 then compares this measured value with the reference value R. If the measured value is greater than the reference value R, the computer 20 then detects that the pressure of the fuel C has reached a desired threshold. If the measured value is greater than the reference value R, the piston 110 has reached its high position before the end of the period D, indicated by a point of inflection that has been exceeded. This means that the piston 110 has moved more rapidly and therefore that it did not start from the low position. In other words, the piston 110 has not had the time, since the end of the preceding step of controlling the solenoid 130, to move to its low position. This is due to the fact that the pressure of the fuel C in the compression chamber has reached the desired threshold and the force exerted by the fuel C on the piston 110 has slowed its movement. The method then moves on to step 90 in FIG. 3, which determines the end of the priming method. The control of the pump is stopped.

If the measured value is less than the reference value R, the computer 20 controls the solenoid 130 again as above, repeating the measurement and comparison steps, which is embodied by the arrow 81 in FIG. 3 and the repetition of steps 60, 70, and 80.

When the pressure of the fuel C in the compression chamber has reached the desired threshold (step 90), the combustion engine of the vehicle 1 can therefore be started: the pressure of the fuel C then makes it possible to inject the optimum quantity of fuel C into the combustion engine.

The presence of a more or less marked point of inflection on the curve I2 is determined in particular by the evolution of this curve, which depends on the starting position of the piston (intermediate position or position very close to the high position), and to a lesser extent on the detailed design of the solenoid (more or less variation in the inductance as a function of the position of the piston).

The invention claimed is:

1. A method for managing a piston pump of a fuel injection system on board a combustion engine vehicle using a computer of said vehicle, in the starting phase of the vehicle during which the pump operates to pressurize the fuel when the combustion engine has not yet started, said pump comprising a guide, a piston slidably mounted in said guide in order to form a fuel compression chamber, and a solenoid suitable for, when a control current generated by the computer passes through the solenoid, moving the piston between a low position in which the compression chamber is suitable for being emptied of fuel and a high position in which the compression chamber is suitable for being filled with fuel—the intake phase—and a return spring acting on the piston to return the piston to the low position in the absence of said control current passing through the solenoid—the compression phase—said method comprising, as long as the fuel pressure in the compression chamber is below a predetermined pressure threshold:

the piston initially being under the effect of the return spring, causing the computer controlling the solenoid to move the piston to the piston's high position, after a predetermined period, causing the computer to measure a value of the intensity of the current passing through the solenoid, next, suspending the controlling of the solenoid so that the return spring actuates the piston to the low position, repeating the three steps above a minimum number of times in order to ensure that the fuel pressure increases, and causing the computer to detect that the predetermined pressure threshold has been exceeded when the measured current value is greater than a predetermined reference value, so that the computer ceases controlling the solenoid, the operating period of the pump thus being limited, in the starting phase of the vehicle when the combustion engine has not yet started, through the detection of the exceeding of a pressure threshold, making it possible to ensure that the fuel is pressurized while minimizing the period during which the pump generates noise.

2. The method as claimed in claim 1, comprising a preliminary initialization step comprising:

the piston initially being in the piston's low position under the effect of the return spring, causing the computer to control the solenoid in order to move the piston to the piston's high position, at the end of the predetermined period, causing the computer to measure the value of the intensity of the current passing through the solenoid, known as the "reference value (R)", followed by a sub-step of the computer ceasing to control the solenoid in order to move the piston to the piston's low position under the effect of the return spring.

3. The method as claimed in claim 2, comprising a step of adjusting the reference value (R).

4. The method as claimed in claim 3, in which the reference value (R) is adjusted by increasing the value of the intensity of the current measured during the measuring sub-step by a predetermined value.

5. The method as claimed in claim 1, in which the measurement step and the comparison step are repeated at a predetermined frequency.

6. The method as claimed in claim 5, in which these steps are repeated a minimum number of times in order to ensure that the fuel pressure increases.

7. The method as claimed in claim 1, in which as the piston pump supplies an engine of a vehicle, the method comprises an initial step of detecting that the ignition switch of said vehicle has been engaged.

8. A computer for managing a piston pump of a fuel injection system on board a combustion engine vehicle, said pump comprising a guide, a piston slidably mounted in said guide in order to form a fuel compression chamber, a solenoid suitable for, when a control current generated by the computer passes through solenoid, moving the piston between a low position in which the compression chamber is suitable for being emptied of fuel and a high position in which the compression chamber is suitable for being filled with fuel—the intake phase—and a return spring acting on the piston to return the piston to the low position in the absence of said control current passing through the solenoid—the compression phase—said computer being configured to implement the steps of a method as claimed in claim 1.

9. A vehicle comprising a combustion engine and a piston pump supplying said combustion engine with fuel, said pump comprising a guide, a piston slidably mounted in said guide in order to form a fuel compression chamber, a solenoid suitable for, when a control current generated by the computer) passes through the solenoid, moving the piston between a low position in which the compression chamber is suitable for being emptied of fuel and a high position in which the compression chamber is suitable for being filled with fuel—the intake phase—and a return spring acting on the piston to return the piston to the low position in the absence of said control current passing through the solenoid—the compression phase—said vehicle comprising a computer as claimed in claim 8, configured to control said piston pump.

10. The method as claimed in claim 1, comprising a step of adjusting the reference value (R).

11. The method of claim 4, wherein the predetermined value is on the order of 0.5 A.

12. The method of claim 5, wherein the predetermined frequency is on the order of 10 ms.

13. The method of claim 6, wherein the minimum number of times is 10.

14. The method as claimed in claim 2, in which the measurement step and the comparison step are repeated at a predetermined frequency.

15. The method as claimed in claim 3, in which the measurement step and the comparison step are repeated at a predetermined frequency.

16. The method as claimed in claim 4, in which the measurement step and the comparison step are repeated at a predetermined frequency.

17. The method as claimed in claim 2, in which as the piston pump supplies an engine of a vehicle, the method comprises an initial step of detecting that the ignition switch of said vehicle has been engaged.

18. The method as claimed in claim 3, in which as the piston pump supplies an engine of a vehicle, the method comprises an initial step of detecting that the ignition switch of said vehicle has been engaged.

19. The method as claimed in claim 4, in which as the piston pump supplies an engine of a vehicle, the method comprises an initial step of detecting that the ignition switch of said vehicle has been engaged.

20. The method as claimed in claim 5, in which as the piston pump supplies an engine of a vehicle, the method comprises an initial step of detecting that the ignition switch of said vehicle has been engaged.

* * * * *